United States Patent [19]

Rudich, Jr. et al.

[11] 4,303,385

[45] Dec. 1, 1981

[54] DIRECT IGNITION SYSTEM FOR GAS APPLIANCE WITH DC POWER SOURCE

[75] Inventors: George Rudich, Jr.; Russell B. Matthews, both of Goshen, Ind.

[73] Assignee: Johnson Controls, Inc., Milwaukee, Wis.

[21] Appl. No.: 47,130

[22] Filed: Jun. 11, 1979

[51] Int. Cl.[3] ..... F23N 5/00

[52] U.S. Cl. ..... 431/70; 431/71; 431/78

[58] Field of Search ..... 431/25, 46, 69, 71, 431/78, 70

[56] References Cited

U.S. PATENT DOCUMENTS

| | | | |
|---|---|---|---|
| 4,111,639 | 9/1978 | Matthews | 431/46 |
| 4,116,613 | 9/1978 | Matthews | 431/78 |
| 4,197,082 | 4/1980 | Matthews | 431/71 |
| 4,260,362 | 4/1981 | Matthews | 431/69 |

*Primary Examiner*—Carroll B. Dority, Jr.

*Attorney, Agent, or Firm*—Emrich, Root, Lee, Brown & Hill

[57] ABSTRACT

An ignition system for use with a source of dc (or full-wave-rectified) power without the need for an inverter includes a flame sensing relay and a checking relay interlocked to achieve lockout if the proper starting sequence or timing are not met or if a flame-out occurs during operation. The checking relay is energized in response to a call-for-heat signal to isolate the flame detection circuitry from its source and commence a trial-for-ignition period in the flame detection circuitry which includes a timing circuit. The timing circuit actuates the flame-sensing relay during the trial-for-ignition period. The flame sensing relay energizes the fuel valve and a spark generator to ignite the fuel. If a flame is detected during the trial-for-ignition period by a flame probe, the timing circuit is disabled and operation continues until the call for heat is terminated as long as the flame is sensed. Another circuit senses flame at the spark gap and disables the spark gap generator after a flame is established. If a flame-out or fuel interruption occurs, the spark generator is re-energized, and the timing circuit is enabled to commence a re-ignition timing period, after which the flame relay is disabled and the system is locked out if ignition is not proved. Once locked out, the system can be re-started only by cycling the thermostat or a remote switch. A minimum re-cycle time is defined by a charging circuit connected to the timing circuit when either switch is re-cycled.

22 Claims, 1 Drawing Figure

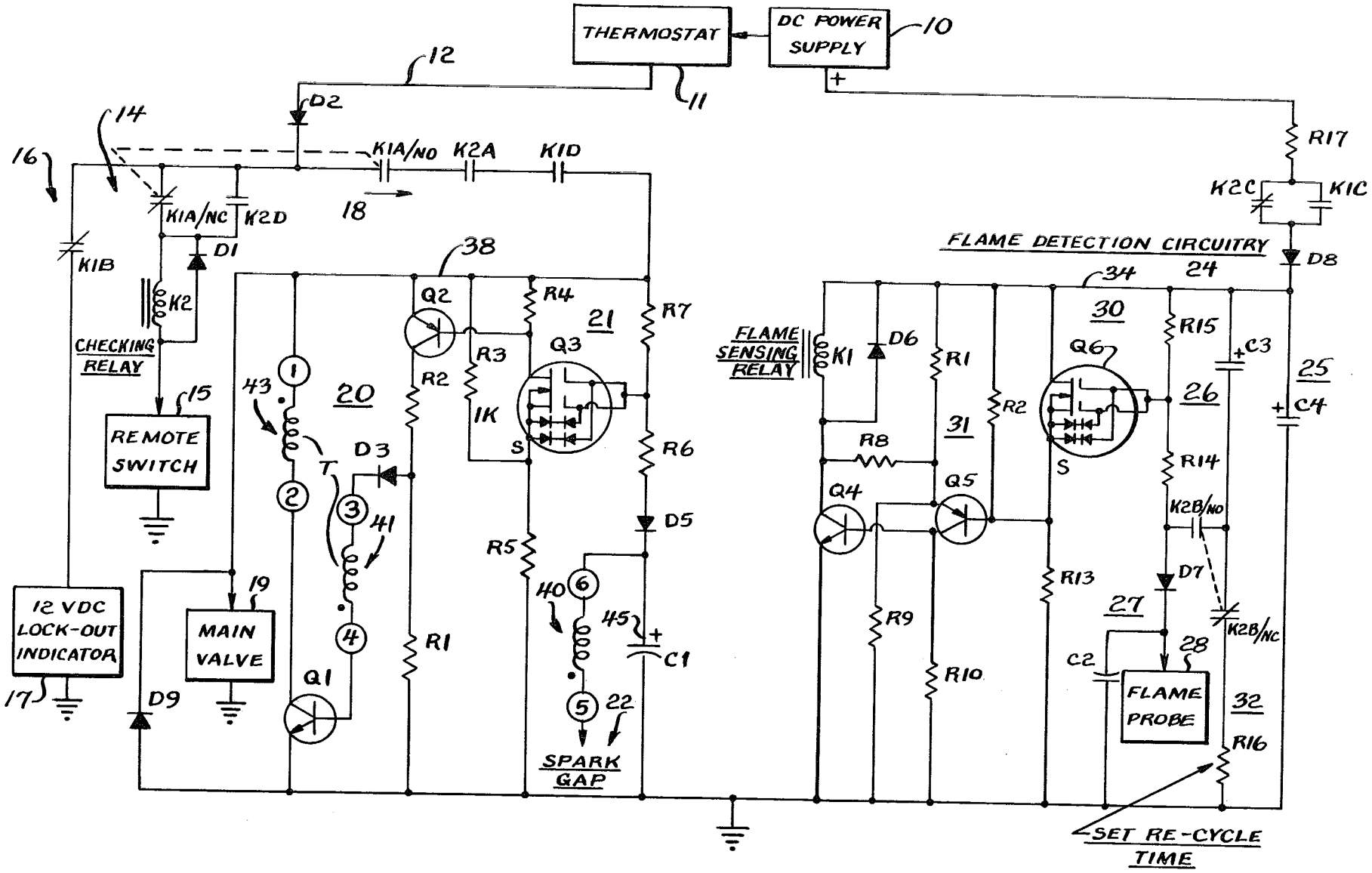
DC POWER SUPPLY
THERMOSTAT
FLAME DETECTION CIRCUITRY
FLAME SENSING RELAY
FLAME PROBE
SET RE-CYCLE TIME
SPARK GAP
MAIN VALVE
REMOTE SWITCH
CHECKING RELAY
12 VDC LOCK-OUT INDICATOR

DIRECT IGNITION SYSTEM FOR GAS APPLIANCE WITH DC POWER SOURCE

BACKGROUND AND SUMMARY

The present invention relates to ignition control systems of the type used to ignite a gaseous fuel; and more particularly, it relates to an ignition control system which ignites the fuel directly, as distinguished from the type which first ignites a pilot flame which, in turn, ignites the main burner. A system of this type is referred to as a direct ignition system in this art.

Direct ignition systems are known, but for the most part they employ sources of alternating current to supply the electrical energy rather than direct current (dc). Such systems normally have a predetermined period after the main fuel valve is opened during which ignition is attempted. If ignition is successful, a flame is established, and a flame probe (which may be a pair of electrodes placed in the flame and spaced apart) is used to detect the presence of a flame. If a flame is present and an ac voltage is applied to the electrodes, the ionization of gas molecules caused by the presence of the flame will permit current to flow unidirectionally between the electrodes. Thus, the flame probe acts as a rectifier if an ac voltage is applied if and only if a flame is present.

A problem arises where it is desired to use such a system in an environment where the only source of electrical energy available is a battery or other dc source, such as in a recreational vehicle, camper or the like, in which the output of the alternator resembles a full-wave-rectified voltage. If the flame sensor relies on bidirectional conductance rather than rectification, a piece of fallen scale bridging the electrodes may create a false signal indicating the presence of a flame when none is in fact present.

In the past, it has been the practice to use an inverter to convert the dc power to ac power and use a system of the type described wherein the presence of a flame is detected by means of the rectification phenomenon mentioned above. An inverter obviously adds cost to such a system and it is also wasteful of electrical energy in use.

Another problem arises in systems of this type—namely, when a flame-out or interruption of fuel occurs each manufacturer of a different furnace (or other gas-fired appliance) may recommend a different delay period before a new ignition cycle is attempted. That is, depending upon the design of the appliance, it may be desirable to allow time for purging of any remnant fuel from the firebox area. This period is called the re-cycle period, and a manufacturer of ignition control systems must accommodate the variations in re-cycle time likely to be encountered.

Another area of design in fuel ignition systems in which improvement is continuously sought is that of safety. Not only is it desired that lockout occur if the operating sequence and timing are not followed implicitly, but it is also desirable that the system not malfunction due to component failure, such as the shorting of a capacitor or the like. It is thus a principal object of the present invention to provide an ignition control system which may be used directly with a source of dc electrical power (or rectified ac power) without the need of an inverter, and to provide such a system with the desired interlocks for timing and sequence of operation which are a necessary part of a fail-safe system. At the same time, it is desired to provide such a system in which adjustments in the trial-for-ignition period and the re-cycle period are easily accommodated with changes only in circuit component values, and without the need to re-design the circuit functions.

The present invention employs a first relay (called a "flame sensing" or simply "flame" relay) and a checking relay. The checking relay is connected in circuit with a thermostat and a manually actuated switch called a "remote" switch, which may be used to re-cycle the ignition control system in the event of a flame-out or shut down for loss of fuel.

The two relays are interlocked by means of their contacts to insure that the system operates in proper sequence before the main fuel valve is actuated. A trial-for-ignition circuit is arranged to energize the coil of the flame relay, and it includes a timing circuit and a drive circuit. In response to a call-for-heat signal from the thermostat, the checking relay opens a set of contacts interposed between a source of dc power and the timing and drive circuits. At the same time, a capacitor in the timing circuit is connected to energize the drive circuit which, in turn, energizes the flame relay for a predetermined trial-for-ignition time. Energy is supplied to the drive circuit and the flame relay by an initiation timing circuit which also includes a charged capacitor isolated from the power source temporarily during an ignition cycle.

A flame probe, adapted to sense the presence of a flame at the burner, is connected in circuit with the timing circuit when the checking relay is energized, and if the presence of a flame causes the probe to conduct bilaterally, the timing capacitor is prevented from completely discharging. Hence, the drive circuit for the checking relay remains actuated. However, should flame be lost for any reason, the timing circuit will commence a re-ignition time-out cycle (which is slightly shorter than the original period), and if a flame is not reestablished during this period, lockout will occur. Further, if a piece of conductive material becomes lodged between the flame electrodes so as to cause a false conduction signal, when the call-for-heat is satisfied and the ignition circuit is de-energized when the thermostat contacts open, the control system cannot be re-started because of the interlock with the flame sensing relay, which remains energized.

If a lockout does occur through a loss of flame for greater than a predetermined time, the system can be re-started by cycling either the thermostat or the remote switch. In this case, when either the thermostat or remote switch is opened, a charge limiting resistor is connected in circuit with the timing capacitor to limit the charging time for that capacitor. The capacitor must charge to a predetermined voltage before it can store sufficient charge to actuate the drive circuit. Hence, the re-cycle time can be adjusted by varying the charge-limiting resistor. Further, the trial-for-ignition time can be varied by varying the value of the capacitor in the timing circuit.

When the flame relay is energized during the trial-for-ignition period, it energizes the checking relay through the thermostat contacts. If both relays are operated in the proper sequence, they cooperate to energize the main fuel valve as well as a spark generator circuit. The spark generator circuit is an oscillator, the output of which is coupled to a spark gap for ignition fuel from the main valve. An enable circuit is connected to the spark gap to enable the spark generator if the spark gap is non-conducting (i.e. a flame is not present). During ignition sparks strike across the spark gap with a random polarity, and eventually a charge of predetermined polarity appears on a capacitor connected across the spark gap to disable the enable circuit, thereby disabling the spark generator. The spark generator remains disabled for so long as the spark gap remains in its relatively high conductance state (indicating the presence of a flame).

With the present invention, if a piece of scale drops across the spark gap, the spark generator will be disabled. If this occurs prior to ignition, the flame probe will cause the timing circuit to time out and lock the system out since no flame is sensed. If it occurs during a fuel cycle, after the cycle terminates or a flame-out occurs, the system will lock out for the same reason.

If a piece of scale drops across the flame probe while the system is operating to supply fuel, operation continues normally, but the system will not re-start. If, on the other hand, a piece of scale shorts the flame probe electrodes when the system is not energizing the main fuel valve, then the system cannot commence an ignition cycle.

Thus, the present invention provides a fail-safe ignition control system for a gas-fired appliance which can use dc power directly without the need for an inverter.

Other features and advantages of the present invention will be apparent to persons skilled in the art from the following detailed description of a preferred embodiment accompanied by the attached drawing.

THE DRAWING

The single FIGURE is a circuit schematic diagram of an ignition control system incorporating the present invention, partly in functional block form.

DETAILED DESCRIPTION

Referring then to the drawing, reference numeral 10 designates a source of dc electrical power, such as a 12 v. battery as is commonly used in recreational vehicles or the like. Power is fed to a conventional thermostat 11 which includes a set of contacts for generating a call-for-heat signal on a line 12. The signal is coupled through a diode D2 to three principal branches of the circuit. One branch, generally designated 14 includes the coil of a checking relay K2 and a remote (reset) switch 15. This switch may be located at any convenient location according to the application—for example, in the case of a water heater where the thermostat is not in a convenient location, switch 15 may be located on a wall. If the thermostat is convenient, switch 15 is not needed. A second branch generally designated 16 includes a lockout indicator 17 which may be an incandescent lamp or a Light Emitting Diode if it is desired to conserve power.

The third branch is generally designated 18, and it includes a spark generator generally designated 20 which is enabled by a first enabling circuit 21. This branch of the circuit also includes a spark gap 22. The spark gap 22 comprises a pair of electrodes set apart at a predetermined distance to define the gap. The electrodes are assembled to a burner to be supplied with gas in a manner such that the gas will pass through the gap and be ignited when a spark is generated between the electrodes. The electrode remains in the flame after the gas is ignited and continues to burn. Spark gaps of this type are well known in the industry.

Turning now to the right side of the circuit diagram, dc power is coupled through relay contacts to be described to Flame Detection Circuitry 24 which includes the following circuits: (1) an initiation timing circuit generally designated 25; (2) a trial-for-ignition timing circuit 26; (3) a flame sensing circuit 27 which includes a flame probe 28; (4) a second enabling circuit 30; (5) a drive circuit 31; (6) the coil of a flame sensing relay K1; and (7) a re-cycle timing circuit generally designated 32.

One function of the flame sensing relay is to shut off the main gas valve 19 if a flame is not sensed by the detection circuit 27 within a predetermined time after a call-for-heat signal is generated by the thermostat 11. This time is determined by the trial-for-ignition circuit 26. During the trial-for-ignition period, the circuit 26 actuates the second enabling circuit 30 which, in turn, energizes the drive circuit 31 for energizing the flame sensing relay K1. If a flame is detected during the trial-for-ignition period, the flame sensing circuit 27 inhibits the timing circuit 26 from timing out completely, and sustains the actuation of the enabling circuit 30.

The initiation timing circuit 25 provides carry-over power to energize the circuits just described when the checking relay K2 is energized in response to a call for heat, as will be made more clear from subsequent description.

In the event of a flame-out or temporary loss of fuel before the call for heat has been satisfied, the system will lock out in a state in which the checking relay K2 is energized, and the flame sensing relay K1 is de-energized. Once this has happened, the only way to commence a new trial-for-ignition cycle is to re-cycle either the reset switch 15 or the thermostat 10. By re-cycle is meant that either switch is opened and then closed. There is a minimum time, called the re-cycle time, during which either of these switches must remain open for the control system to respond. This minimum time is defined by the re-cycle timing circuit 32.

Turning now to the detail of the circuitry, a resistor R17 is connected in series with the dc power supply 10. A pair of contacts including a normally closed contact K2C and a normally open contact K1C are connected in parallel, between the resistor R17 and a diode D8, the cathode of which is connected to a line 34 which acts as a supply bus to the flame detection circuitry 24. The initiation timing circuit 25 comprises a capacitor C4 connected between the bus 34 and ground. This capacitor also acts as a filter if the system is connected to the output of an alternator, which output is similar to a full-wave rectified DC voltage.

The principal element of the trial-for-ignition timing circuit comprises a capacitor C3 having one terminal connected to the bus 34, and a second terminal connected by means of normally closed contacts K2B/NC to a resistor R16 comprising the re-cycle timing circuit 32.

The trial-for-ignition timing circuit 26 also includes resistors R15 and R14 connected in series and adapted to be connected across the timing capacitor C3 to provide a discharge path therefor by a set of normally open contacts K2B/NO (which are mechanically ganged to contacts K2B/NC) when the checking relay K2 is energized. The junction between resistor R14 and contacts K2B is connected by means of a diode D7 to the flame probe 28; and a capacitor C2 is connected in parallel with the flame probe 28.

The flame probe 28 is an assembly which includes at least one electrode spaced from a grounded portion of the burner and located in the flame when it exists. When a flame is not present, the flame probe 28 has a relatively low conductance (high electrical resistance), and when a flame is present, it is in a state of relatively high conductance (low resistance). The presence of a flame is detected if the resistance of the flame probe is less than about 50 megohms.

Enabling circuit 30 includes a dual-protected-gate MOSFET transistor Q6 having its gates connected to the junction between resistors R14 and R15 of the timing circuit 26, its drain connected to the lead 34, and its source (output) connected to (a) ground through a resistor R13, (b) power bus 34 through resistor R2, and (c) the base of transistor Q5. The gate 30 is arranged as a source follower so that its output voltage (which drives transistor Q5) follows the input voltage.

The emitter of transistor Q5 is connected to the lead 34 by resistor R1, and to ground by resistor R9. The collector of transistor Q5 is connected to ground via resistor R10, and it is connected to the base of a second transistor Q4 in the drive circuit 31. The emitter of Q4 is connected to ground; the coil of the flame sensing relay K1 is in its collector circuit. A resistor R8 provides negative feedback from the collector of transistor Q4 to the emitter of transistor Q5 to reduce oscillation. A diode D6 is connected across the coil of the flame sensing relay to protect transistor Q4 against high voltage transients.

In operation, the source terminal S of MOSFET Q6 is a signal which follows the signal at its gate terminals. During a trial-for-ignition cycle, this signal will be abruptly reduced and then rise toward the positive voltage level on the bus 34, as will be described more fully below. Resistors R1 and R9 form a voltage divider for establishing a quiescent reference voltage on the emitter of transistor Q5 of the drive circuit 31. When the voltage on the lead S goes sufficiently negative relative to the quiescent reference voltage on the emitter of transistor Q5 to forward bias the emitter-base junction of transistor Q5 at the commencement of a trial-for-ignition period, both transistors Q5 and Q5 conduct, and the gain is sufficient to saturate transistor Q4, thereby energizing the coil fo the flame sensing relay K1.

Turning now to the left side of the circuit diagram, the path 16 includes normally closed contacts K1B connected in series with the lockout indicator 17. The path 14 includes normally closed contacts K1A/NC and normally open K2D connected in parallel, the parallel circuit being connected in series with the coil of the checking relay K2 (which has diode D1 connected across it for transient protection). The coil of the checking relay K2 is connected in series with the remote switch 15, which in the illustrated embodiment is a normally closed switch. The switch 15 may also be used for remote system shut-down. It will be observed that during a call for heat when the thermostat contacts are closed, if either the thermostat contacts or the remote switch are cycle, the coil of the checking relay K2 will be de-energized.

The circuit path 18 includes, in series circuit, normally opened relay contacts K1A/NO, K2A, and K1D. This series circuit couples dc power from the supply 10 through the thermostat 11 to a bus 38. The solenoid for the main valve 19 is connected between the bus 38 and ground. A diode D9 is connected across the coil of valve 19 to protect the circuit from transients which can be generated by the coil. Contacts K1A/NO and K1A/NC are mechanically interlocked.

The enabling circuit 21 contains a second MOSFET Q3 having its gates connected to the junction between resistors R7 and R6. The other terminal of resistor R7 is connected to the bus 38, and the other terminal of resistor R6 is connected through a diode D5 and a secondary winding 40 of a transformer (to be described) to the spark gap 22. A capacitor C1 is connected across the secondary winding 40 and the spark gap 22.

A resistor R4 is connected between the drain of Q3 and the bus 38. A voltage divider including resistors R3 and R5, connected between but 38 and ground, provide a reference voltage for the source S of transistor Q3 to thereby define a threshold for the actuation or firing of the enabling circuit 21.

The output of the enabling circuit 21 is connected to the base of a transistor Q2, having its collector connected via series resistors R1 and R2 to ground and its emitter connected to bus 38. The junction between resistors R1 and R2 is connected via diode D3 to a secondary or "tickler" winding 41 of transformer T, the other terminal of which is connected to the base of transistor Q1. The emitter of Q1 is grounded, and its collector is connected via the primary winding 43 of the transformer T to the bus 38. Transformer T is a high Q circuit itself. The circuitry forms a tuned collector oscillator which commences oscillation when the transistor Q1 is biased into the active region by the enable circuit 21. A further secondary winding 40 of the transformer has a large number of turns relative to the primary winding 43 to induce a high voltage across the spark gap 22 when the spark generator 20 (comprising the transformer and transistors Q1 and Q2 principally) is enabled.

When the main valve 19 is actuated it permits fuel to flow from the burner; and, after a brief delay caused by the charging of capacitor C1, the spark generator 20 is also enabled, thereby generating a high voltage across the secondary winding 40. The spark gap 22 and capacitor C1 are connected in series across the winding 40. The high voltage will cause an arc to strike across the spark gap, and the polarity of the resulting discharge may be either positive or negative. Whichever polarity it is, it will cause a charge buildup on capacitor C1 of opposite polarity, thereby creating a tendency that the next arc will be of a polarity opposite to the first. If the voltage buildup is in the polarity shown in the drawing, the enable circuit 21 will continue to be energized. However, when a negative polarity builds up on terminal 45 of capacitor C1, the gates of Q3 will be drawn to a negative voltage and the enabling circuit 21 will be disabled, thereby disabling the spark generator 20. If, at this time, a flame is present, then the spark gap will be in a state of relatively low (around 50 Megohms or less) and the capacitor C1 will not be permitted to charge from the dc source, so the spark generator will remain disabled until the flame is no longer present. Thus, capacitor C1 performs a number of functions. It provides an original delay; it is part of a disable circuit for the spark generator after it is enabled, and it is part of the flame sensing circuitry for the spark gap to keep the spark gap generator turned off.

OPERATION

When the dc power supply 10 is connected, it energizes the flame detection circuitry (particularly bus 34)

through the normally closed contact K2C and diode D8.

Capacitor C4 of the initiation timing circuit 25 charges to the full battery potential through resistor R17. Similarly, capacitor C3 of the trial-for-ignition timing circuit 26 charges through the normally closed contact K2B/NC, resistor R17 and the re-cycle timing resistor R16, again to to full battery supply voltage (less the drop across diode D8, of course). With no flame present, current cannot flow through the flame probe 28; hence, the potential at the gates and source S of MOSFET Q6 is relatively high and transistors Q5 and Q6 are not conducting. As long as the enable circuit 30 is not energized, the drive circuit 31 is inactive, and the flame sensing relay K1 cannot be energized.

When the temperature of the room falls below the setting of the thermostat 11 (or conversely, the setting of the thermostat is raised), and the thermostat contacts close, power is coupled from the supply 10 through the thermostat 11 to the line 12 to generate a call-for-heat signal. The checking relay K2 is energized immediately through the normally closed contacts K1A and the normally closed remote switch 15. Thus, holding contacts K2D close to maintain an energizing path for the coil of checking relay K2. Further, normally open contacts K2A in circuit path 18 close. The circuit path is not energized because relay K1 is not energized at this time.

When the checking relay is energized, contacts K2C open, and at the same time, the mechanically-ganged contacts K2B/NC and K2B/NO are actuated. When contacts K2C open, the flame detection circuitry 24 is isolated from the power supply 10. The initiation circuitry, principally capacitor C4, supplies a carry-over charge during this period. When contacts K2B/NO close, capacitor C3 of the trial-for-ignition timing circuit 26 is connected across the series circuit comprising resistors R15 and R14. Further, as contacts K2B/NC open, the charge path for capacitor C3 is interrupted.

Because the capacitor C3 is charged to substantially the full supply voltage at the time contacts K2B/NO close, and because the positive terminal of capacitor C3 is directly connected to the positive bus 34, the voltage at the gates of Q6 decreases instantaneously and then rises according to the time constant for the ignition timing circuit which is determined by the values of C3, R15 and R14. Since the MOSFET Q6 is connected as a source follower, the voltage at the source terminal S follows the voltage across capacitor C3 less the drop across the source-gates junction of Q6 and across R14 which is substantially smaller than R15. When the voltage at the source S drops to the initial level, transistor Q5 is immediately forward-biased, and the driver circuit 31 energizes the coil of the flame sensing relay K1.

When the flame sensing relay K1 is energized, contacts K1C close to provide a holding path for the flame detection circuitry. At the same time, contacts K1B open in circuit path 16 to de-energize the lock-out indicator 17. At the same time, contacts K1A/NO and K1D close to energize circuit path 18, thereby immediately energizing the main valve 19 and permitting gas to flow through the burner.

Since there is no flame at this time, the spark gap 22 is an open circuit. When contacts K1A and K1D close, power is coupled through the thermostat 11, diode D2 and circuit path 18 to the lead 38. Terminal 45 of capacitor C1 begins to charge to a positive voltage. When the voltage on the gates of MOSFET Q3 reaches a voltage near the voltage on the source terminal S, Q3 begins to conduct, current flows through resistor R4, and the voltage at the drain terminal of Q3 goes relatively negative, thereby causing transistor Q2 to conduct, supplying current to the base of transistor Q1 and causing it to conduct. When transistor Q1 switches on, current builds up in the primary winding 43 of the transformer, and it also induces a voltage in the secondary 41 of such a polarity as to cause the transistor Q1 to oscillate. Further, a voltage is induced in secondary winding 40 to generate an arc across the gap 22. As oscillations continue in the spark generator 20, additional arcs are generated in the gap 22.

When the spark gap 22 conducts, the energy in the plasma ignites the fuel. When the voltage on the secondary winding 40 on the transformer is sufficiently high to strike an arc across the spark gap 22, it causes capacitor C1 to charge in a polarity bucking the direction of current flow through the spark gap 22. This provides a bias tending to cause the next arc to strike in the opposite direction because the voltage on C1 then adds to the voltage induced in the winding 40. Thus, capacitor 45, during the operation of the spark generator 20, tends to charge in positive and negative polarities in a somewhat random fashion. When this charge on the capacitor C1 is such that the terminal 45 goes positive, it has no effect on the continued operation of the enable circuit 21 and the spark generator 20 continues in operation. However, when the terminal 45 of capacitor C1 charges to a sufficient negative voltage, the voltage at the gates of MOSFET Q3 will eventually reach a voltage low enough to cause the MOSFET to become non-conducting, thereby disabling the spark generator 20. If, at the time the spark generator 20 is disabled, a flame exists at the spark gap 22, there will be conduction across the spark gap 22. This will discharge the capacitor C1, and it will also provide a resistance to ground. The value of resistor R7 is chosen in relation to the maximum expected resistance of the spark gap 22 in the presence of a flame such that when a flame is present and the spark gap 22 is in a state of relatively high conductance as distinguished from its high resistance when there is no flame, the gates of MOSFET Q3 are at a voltage low enough to cause the MOSFET Q3 to become non-conducting. If ignition has been achieved, the flame will be sensed by capacitor C1 through secondary winding 40 as a resistance to ground, and the capacitor cannot charge to fire MOSET Q3. If flame is lost, the spark gap returns to its state of relatively high resistance, capacitor C1 charges and Q3 will again be enabled.

If flame is lost and the spark is turned on, flame will also have been lost at the flame probe 28. Thus, the flame probe 28 returns to its state of relatively low conductance, and the capacitor C3 will begin to discharge, but from a voltage less than the full terminal voltage of the supply (due to the voltage divider network formed by resistors R15 and R14 and the flame probe in the presence of a flame). If the flame is not restored before capacitor C3 discharges to the point where it can actuate the enable circuit 30, the flame sensing relay K1 is de-energized, contacts K1C open, and the flame detection circuitry will be shut off and locked out. At the same time, contacts K1A/NO and K1D will open to de-energize the main valve 19 and the spark generating circuit 20. Thus, the only components which have power applied to them are checking relay K2 and the lockout indicator 17 (through normally closed contacts K1B).

Diodes D1 and D8 provide protection against inverting the polarity of the power supply 10.

Resistor R17 acts as a limit resistor to protect against excessive voltage on the coil of flame sensing relay K1, and permits the use of relatively inexpensive AC/DC converters in place of the power supply 10 such as simple full wave rectifiers.

Diodes D1, D9 and D6 cooperate with their associated inductive loads to prevent any inductive voltage spikes from being transmitted to the rest of the circuitry.

Contact K1A (in series with the coil of checking relay K2) is an interlocking contact which insures that if the flame sensing relay K1 is energized before the checking relay K2, the circuit will not operate because contact K2A is inserted in circuit path 18 leading to the valve 19. If the checking relay K2 is energized, but the flame sensing relay K1 is not energized, then redundant contacts K1A and K1D, also in circuit path 18, will not close and thereby prevent actuation of the fuel valve 19. If a flame is not sensed by the flame probe 28 prior to the time that the trial-for-ignition timing circuit times out, enable circuit 30 disables drive circuit 31, thereby causing flame sensing relay K1 to be de-energized. Contacts K1C open to lock out the flame detection circuitry.

If a piece of scale causes a fault in the flame probe 28 during a heating cycle, the flame relay will remain energized, thereby locking out the checking relay K2 upon the next call for heat. If the short occurs prior to a call for heat, K2 will not be energized because the flame relay will be energized and contacts K1A/NC will be open.

If a flame is sensed by the probe 28 during the trial-for-ignition period, the flame probe 28 conducts, the gates of MOSFET Q6 are fixed at a voltage determined by the divider network including resistors R14, R15, diode D7 and the flame probe 28. Resistor values are chosen so that the value of the resistor R14 is relatively small, and the value of resistor R15 is about equal to the maximum resistance of the flame probe 28 during conductance in the presence of a flame. Hence, a residual charge on capacitor C3 is equal to about one-half the power supply voltage. The voltage at the gates of MOSFET Q6 is, however, during this stage, sufficiently low as to cause transistor Q5 to be conducting.

If flame is lost, the probe 28 becomes open-circuited, and the timing circuit 26 begins a re-ignition period in which capacitor C3 discharges its residual charge through resistors R14 and R15. If a flame is not sensed during re-ignition (which may be approximately 60–75% of the original ignition period), the voltage at the source S of MOSFET Q6 becomes high enough to turn off transistor Q5, thereby disabling the drive circuit 31 and de-energizing flame sensing relay K1. With relay K2 energized and relay K1 de-energized, the flame detection circuitry becomes locked out.

Once the flame detection circuitry is locked out, it can only be re-energized by cycling (that is, opening and then closing) either the thermostat 11 or the remote switch 15. When either one of these switches is opened, the checking relay K2 becomes de-energized, and contacts K2C close, thereby supplying power to bus 34. At the same time, contacts K2B/NO open to isolate capacitor C3 from its discharge network, and contacts K2B/NC close to provide a charging path to ground for capacitor C3 by inserting resistor R16. The thermostat or remote switch must be left open for enough time to permit capacitor C3 to charge to a sufficient voltage that when contacts K2B/NO again close, the negative terminal of capacitor C3 will bring the gates of MOSFET Q6 to a sufficiently low voltage that the drive circuit 31 will be energized by causing transistor Q5 to conduct. Thus, the value of capacitor C1 may be varied to set the trial-for-ignition period, and the value of resistor R16 may be varied to set the re-cycle time.

Table I below sets forth various circuit values for the system illustrated in the drawing for exemplary purposes only, and not in any way to limit the scope of the invention. In the table, resistance is given in ohms, and capacitance in microfarads, unless otherwise specified.

Table I

| | Ohms |
|---|---|
| R1 | 150 |
| R2 | 470 |
| R3 | 1,000 |
| R4 | 2,000 |
| R5 | 2,000 |
| R6 | 4.7 M |
| R7 | 47 M |
| R8 | 10 K |
| R9 | 5.1 K |
| R10 | 10 K |
| R11 | 1 K |
| R12 | 5.1 K |
| R13 | 5.1 K |
| R14 | 4.7 M |
| R15 | 47 M |
| R16 | 2.2 K |
| R17 | 30 |
| C1 | .002 |
| C2 | .002 |
| C3 | .068 |
| C4 | 330 |

We claim:

1. In an ignition control system for use with an appliance provided with a source of gas, a valve for supplying gas from said source to said appliance, and a thermostat for generating a call-for-heat signal, the combination comprising: flame relay circuit means normally coupled to a source of dc electrical power and operative when enabled to couple said source to said valve; trail-for-ignition timing circuit means normally coupled to said source for enabling said flame relay circuit means for a limited trail-for-ignition period in response to a call-for-heat signal; probe means having a first conductance state in the presence of a flame in said appliance and a second conductance state in the absence of a flame; switching circuit means responsive to said call-for-heat signal for connecting said trial-for-ignition timing circuit means in circuit with said flame relay circuit means and with said probe means and for temporarily isolating said trial-for-ignition timing circuit means and said flame relay circuit means from said power source; and initiation timing circuit means for supplying carry-over power to said trial-for-ignition timing circuit means and said flame relay circuit means during an initation time interval commencing with the occurrence of said call-for-heat signal and for permitting the system to become locked out with said valve and said flame relay circuit means deenergized if said flame relay circuit means fails to operate during said initiation time interval, said probe means normally being in said second conductance state at the commencement of said trial-for-ignition period and operative to permit said trial-for-ignition timing circuit means to time out and thereupon disable said flame relay circuit means if said probe means does not switch to said first conductance state prior to the end of said trial-for-ignition period.

2. The control system of claim 1 wherein said switching circuit means comprises a checking relay circuit means connected in circuit with said thermostat and energized by a call-for-heat signal therefrom; said initiation timing circuit means including a capacitor connected in circuit with said power source to store charge when said checking relay circuit means is de-energized, said checking relay circuit means when energized disconnecting said power source from said flame relay circuit means, said trial-for-ignition timing circuit means and said initiation timing circuit means, said initiation timing circuit means supplying carry-over power to said flame relay circuit means and said trial-for-ignition timing circuit means until said flame relay circuit means operates, said flame relay circuit means including a holding contact for reconnecting said power source to said initiation timing circuit means, said trail-for-ignition timing circuit means and said flame relay circuit means.

3. The control system of claim 2 wherein said flame relay circuit means comprises normally-closed contacts connected in circuit with said checking relay circuit means whereby if said probe means is in said first conductance state through fault when said call-for-heat signal is generated, allowing said flame relay circuit means to open said contacts, said checking relay will not be operated and said control system will lock out.

4. In an ignition control system for use with an appliance having a source of gas, a main valve for supplying gas from said source to said appliance, and a thermostat for generating a call-for-heat signal, the combination comprising: flame detection circuit means normally coupled to a source of dc electrical power; said flame detection circuit means including flame sensing relay means; checking relay means actuated by said call-for-heat signal; said flame sensing relay means and said checking relay means having contacts interlocking with each other and with said main valve such that said checking relay means and said flame sensing relay means must be energized in sequence before said main valve can be energized; said flame detection circuit means further including drive circuit means for energizing said flame sensing relay means when enabled; timing circuit means operative to supply stored energy to said flame detection circuit means and to enable said drive circuit means for a limited trial-for-ignition period; probe means having a first conductance in the presence of a flame and a second conductance in the absence of a flame; said checking relay means being responsive to a call-for-heat signal for isolating said timing circuit means and said flame detection circuit means from said dc power source, whereupon said flame detection circuit means is energized by stored energy provided by said timing circuit means, and for connecting said timing circuit means in circuit with an enabling input of said drive circuit means and said probe means for permitting said timing circuit means to enable said drive circuit means for said trial-for-ignition period, said probe means preventing said timing circuit means for disenabling said drive circuit means if said probe means is in said first conductance state when said checking relay means connects said timing circuit means to said enabling input of said drive means, said flame sensing relay means being operated for energizing said valve for said trial for ignition period, said probe means changing to said first state of conductance in the presence of a flame to inhibit time out of said timing circuit means and thereby preventing de-energization of said flame sensing relay means, said probe means permitting said timing circuit means to time out and deenergize said flame sensing relay means to shut off said valve if a flame is not sensed by said probe means within said limited time, and said flame detection circuit means being deactivated, preventing the operation of said valve if said flame sensing relay means fails to operate before the energy stored by said timing circuit means is depleted.

5. The control system of claim 4 wherein said flame sensing relay means includes contacts for preventing said checking relay means from being energized in response to a call-for-heat signal if said flame sensing relay means is energized when said call-for-heat signal is generated, and said probe means causes said timing circuit means to continue to enable said drive circuit means if the impedance across said probe means is within a predetermined range.

6. The control system of claim 5 wherein said probe means comprises a pair of spaced electrodes having a state of relatively high bidirectional conductance in the presence of a flame and a relatively low bidirectional conductance in the absence of a flame.

7. The control system of claim 5 further comprising a spark gap adapted to ignite fuel from said valve; spark generator circuit means enabled by said flame sensing relay means for generating a spark across said spark gap to ignite said fuel.

8. The apparatus of claim 7 wherein said spark gap has a relatively high conductance in the presence of a flame and a relatively low conductance in the absence of a flame, said system further comprising enable circuit means adapted to enable said spark generator circuit means and having an input circuit including said spark gap and a capacitor connected across said spark gap, said sparks occurring in random polarity, said enable circuit means being responsive to a charge on said capacitor at one of said polarities for disabling said enable circuit means as long as said flame causes said spark gap to have a relatively low conductance, said capacitor being charged by said source of dc power at said other of said polarities to energize said enable circuit means when said spark gap has said low conductance.

9. The control system of claim 5 further comprising a normally closed remote switch; said checking relay means being connected in circuit with said thermostat and said remote switch whereby if a flame-out or loss of fuel occurs for greater than a predetermined time, said flame probe means will switch to said second state of conductance and permit said timing circuit means to time-out, thereby de-energizing said drive circuit means and said flame sensing relay and said main valve, said checking relay means comprising said switching means for coupling said timing circuit to said drive circuit means, and thereby disabling said coupling until one of said thermostat and said remote switch is opened and closed sequentially.

10. The control system of claim 9 wherein said timing circuit means includes a capacitor, said apparatus further comprising: recycle timing means including a resistor adapted to be connected in circuit with said capacitor of said timing circuit when said checking relay means is de-energized and defining a minimum time for re-cycling one of said thermostat and remote switches by limiting charging current to said capacitor.

11. The control system of claim 5 wherein said timing circuit means comprises trial-for-ignition timing circuit means, said checking relay means having a normally closed contact interposed between said power source and said timing circuit means to thereby isolate said timing circuit means and said flame detection circuit means from said power source when said checking relay means is operated during the commencement of the trial-for-ignition period, said timing circuit means further comprising initiation timing circuit means for providing stored energy to said trial-for-ignition timing circuit and said flame detection circuit means during the commencement of said trial-for-ignition period, said flame sensing relay means including a holding contact adapted to connect said power source of said timing circuit means and said flame detection circuit means when said flame sensing relay means is operated before the stored energy provided by said initiation timing circuit means is depleted.

12. In a direct ignition control system for use with an appliance having a source of gas, a main valve for supplying gas from said source to said appliance, and a thermostat for generating a call-for-heat signal, the combination comprising: flame detection circuitry including first switching means, trial-for-ignition timing circuit means for generating a timing signal for a predetermined time when enabled, and first flame responsive sensor means having first and second conductance states responsive to the absence and presence of a flame respectively; spark generator means including a source of high voltage energy and a spark gap located in the path of fuel from said source and having first and second conductance states in response to the absence and presence of a flame respectively; second switching means responsive to a call-for-heat signal for coupling said trial-for-ignition timing circuit means to said first switching means, enabling said timing circuit means to generate its timing signal and permitting said first switching means to be enabled by said timing signal for said predetermined time, said first switching means, when enabled by said timing signal, actuating said valve and energizing said spark generator means to generate a spark in said spark gap to ignite said fuel, said first flame responsive sensor means preventing time out of said trial-for-ignition timing circuit means when said first flame responsive sensor means switches to said second conductance state, but permitting said trial-for-ignition timing circuit means to time out and thereby de-energize said first switching means if said first flame responsive sensor means does not switch to said second conductance state during said trial-for-ignition period, and second flame responsive sensor means including an enable circuit connected in circuit with said spark gap for enabling said spark generator means when said spark gap is in said first conductance state and for disabling said spark generator means when said spark gap switches to said second conductance state.

13. The control system of claim 12 wherein said spark generator means includes a transformer having a high voltage secondary winding in series with said spark gap, said second flame responsive sensor means includes a capacitor connected in circuit with said spark gap and said high voltage secondary winding to accumulate a charge to disable said spark generator, said spark generator remaining disabled in response to said spark gap's being in said second conductance state.

14. The control system of claim 13 wherein, said capacitor is connected in circuit with said enable circuit for delaying the actuation thereof in response to the energization of said first switching circuit means to permit said valve to be opened before said enable circuit energizes said spark generator means.

15. The control system of claim 12 wherein said second switching circuit means connects said first flame responsive sensor means in circuit with said trial-for-ignition timing circuit in response to a call-for-heat signal, said first flame responsive sensor means inhibiting the actuation of said first switching circuit means by said timing circuit means if said first flame responsive sensor means is in said second conductance state.

16. In an ignition control system for use with an appliance having a source of gas, a main valve for supplying gas from said source to said appliance, and a thermostat for generating a call-for-heat signal, the combination comprising: flame detection circuitry including first switching means, a trial-for-ignition timing circuit including a capacitor which is charged and then permitted to discharge for generating a timing signal for a predetermined time when actuated, and first flame responsive sensor means having first and second conductance states responsive to the absence and presence of a flame respectively; spark generator means including a source of high voltage energy and a spark gap located in the path of fuel from said source and having first and second conductance states in response to the absence and presence of a flame respectively; second switching means responsive to a call-for-heat signal for actuating said trial-for-ignition timing circuit to enable said first switching means for said predetermined time, said first switching means, when enabled by said timing circuit, actuating said valve and energizing said spark generator means to generate a spark in said spark gap to ignite said fuel; and second flame responsive sensor means associated with said spark gap for disabling said spark generator when said spark gap switches to said second conductance state, said first flame responsive sensor means inhibiting further time out of said trial-for-ignition timing circuit when said first flame responsive sensor means switches to said second conductance state, but permitting said trial-for-ignition timing circuit to time out and thereby de-energize said first switching means if said first flame responsive sensor means does not switch to said second conductance state during said trial-for-ignition period, and re-cycle time circuit means, said second switching means connecting said re-cycle time circuit means in circuit with said capacitor of said trial-for-ignition timing circuit and a source of power to permit said capacitor to charge to a sufficient voltage to enable said first switching means for said predetermined time only when said second switching circuit means is de-energized, whereby said system may be re-cycled by opening said thermostat and thereby de-energizing said second switching circuit means.

17. The control system of claim 16 wherein said system further includes a normally closed remote switch connected in circuit with said second switching circuit means to permit said system to be re-cycled by said remote switch.

18. The control system of claim 17 wherein said re-cycle time circuit means includes a resistance having a value defining a minimum time for de-energizing said second switching circuit means to permit said capacitor to charge to a sufficient voltage to enable said first switching circuit means.

19. The control system of claim 18 characterized in that the value of said capacitor in said timing circuit means determines the trial-for-ignition time and the value of the resistor in said re-cycle time circuit means defines the minimum re-cycle time for said thermostat or said remote switch.

20. The control system of claim 19 wherein said flame detection circuitry further comprises initiation timing circuit means including a second capacitor for accumulating charge, said second switching circuit means coupling said flame detection circuitry, including said second capacitor, in circuit with said source of power to permit said second capacitor to accumulate a charge when said second switching circuit means is de-energized, said second switching circuit means de-coupling said flame detection circuitry from said source of power when said second switching circuit means is energized, said second capacitor supplying energy to said flame detection circuitry for an initiation time period defined by the discharge time of said second capacitor, said first switching circuit means including a holding contact adapted to connect said flame detection circuitry to said source of power when said first switching circuit means is operated during said initiation time period.

21. In an ignition control system for use with an appliance provided with a source of gas, a valve for supplying gas from said source to said appliance, and a thermostat for generating a call-for-heat signal, the combination comprising: relay circuit means for coupling a source of electrical power to said valve when energized; timing circuit means for generating a timing signal defining a limited trial-for-ignition period of a first duration in response to a call-for-heat signal; probe means having a first conductance state in the presence of a flame in said appliance and a second conductance state in the absence of a flame; switching circuit means responsive to said call-for-heat signal for connecting said timing circuit means in circuit with said relay circuit means and with said probe means, said timing circuit means including a capacitor which charges to a first valve and then discharges from said first valve, generating said timing signal to permit said relay circuit means to be enabled during said trial-for-ignition period, said probe means normally being in said second conductance state at the commencement of said trial-for-ignition period and operative to permit said timing circuit means to time out and thereupon disable said relay circuit means if said probe means does not switch to said first conductance state prior to the end of said trial-for-ignition period, but to prevent said timing circuit means from timing out and cause said capacitor to charge through said probe means to a second, lesser valve and thereby maintain said relay circuit means enabled when said probe means switches to said first conductance state in response to a flame being established during said trial-for-ignition period, and said probe means being responsive to a flame-out to switch to said second conductance state to cause said capacitor to discharge from said second valve, enabling said timing circuit means to commence a re-ignition time period of a second duration which is shorter than said first duration whenever a flame-out is sensed during a heating cycle, and said timing circuit means disabling said relay means if said probe means does not switch to said first conductance state prior to the end of said re-ignition time period.

22. The control system of claim 21 wherein said system further comprises a re-cycle time circuit means adapted to be connected in circuit with said timing circuit means, said switching circuit means connecting said re-cycle timing circuit means in circuit with said timing circuit means when said thermostat does not generate a call-for-heat signal, said re-cycle time circuit means permitting said capacitor of said timing circuit means to re-charge in a controlled manner from said power source to define a predetermined minimum time for said capacitor to re-charge before a subsequent call-for-heat signal will enable said timing circuit means to enable said relay circuit means during a subsequent trial-for-ignition period.

* * * * *

UNITED STATES PATENT AND TRADEMARK OFFICE

CERTIFICATE OF CORRECTION

PATENT NO. : 4,303,385

DATED : December 1, 1981

INVENTOR(S) : George Rudich, Jr. and Russell B. Matthews

It is certified that error appears in the above—identified patent and that said Letters Patent is hereby corrected as shown below:

Column 12, line 35, "apparatus" should be -- control system --.

Column 16, line 1 (both occurrences), "valve" should be -- value --;

lines 12 and 19, "valve" should be -- value --.

Signed and Sealed this

*Fourth* Day of *May 1982*

[SEAL]

*Attest:*

GERALD J. MOSSINGHOFF

*Attesting Officer*

*Commissioner of Patents and Trademarks*